US010166810B2

(12) United States Patent
Demange et al.

(10) Patent No.: US 10,166,810 B2
(45) Date of Patent: Jan. 1, 2019

(54) OPTICALLY VARIABLE MAGNETIC SECURITY THREADS AND STRIPES

(71) Applicant: SICPA HOLDING SA, Prilly (CH)

(72) Inventors: Raynald Demange, Montagny-près-Yverdon (CH); Dominique Favre, Essert-sous-Champvent (CH); Gebhard Ritter, Lausanne (CH); Jessica Kruegger, Les Paccots (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 15/324,520

(22) PCT Filed: Jun. 17, 2015

(86) PCT No.: PCT/EP2015/063559
§ 371 (c)(1),
(2) Date: Jan. 6, 2017

(87) PCT Pub. No.: WO2016/005158
PCT Pub. Date: Jan. 14, 2016

(65) Prior Publication Data

US 2018/0117951 A1 May 3, 2018

(30) Foreign Application Priority Data

Jul. 9, 2014 (EP) ..... 14176305

(51) Int. Cl.
*B42D 25/00* (2014.01)
*B42D 25/351* (2014.01)
(Continued)

(52) U.S. Cl.
CPC ..... *B42D 25/369* (2014.10); *B42D 25/351* (2014.10); *B42D 25/355* (2014.10);
(Continued)

(58) Field of Classification Search
CPC ..... B42D 25/00; B42D 25/351; B42D 25/355
See application file for complete search history.

(56) References Cited

U.S. PATENT DOCUMENTS 964,014 A 7/1910 Gernaert
4,609,207 A 9/1986 Muck et al.
(Continued)

FOREIGN PATENT DOCUMENTS

CA 2076532 12/1998
DE 4419173 12/1995
(Continued)

OTHER PUBLICATIONS

EP 2465701 A2 Translation.*
(Continued)

*Primary Examiner* — Kyle R Grabowski
(74) *Attorney, Agent, or Firm* — Muncy, Geissler, Olds, & Lowe, P.C.

(57) ABSTRACT

The present invention relates to the field of the protection of value documents and value commercial goods against counterfeit and illegal reproduction. In particular, the present invention relates to security threads or stripes to be incorporated into or onto security documents. The security threads or stripes comprise i) an optically variable layer; ii) a magnetic code; and iii) a non-metallized substrate, wherein the magnetic code has a color matching the color impression of the optically variable layer at one viewing angle and wherein the optically variable layer and the magnetic code are jointly visible from one side of the security thread or stripe.

20 Claims, 2 Drawing Sheets

(51) Int. Cl.

| | |
|---|---|
| ***B42D 25/355*** | (2014.01) |
| ***B42D 25/369*** | (2014.01) |
| ***B42D 25/364*** | (2014.01) |
| ***B42D 25/373*** | (2014.01) |
| ***B42D 25/378*** | (2014.01) |
| ***B42D 25/455*** | (2014.01) |
| ***B42D 25/46*** | (2014.01) |
| ***B42D 25/47*** | (2014.01) |
| *B42D 25/29* | (2014.01) |

(52) U.S. Cl.

CPC ..... *B42D 25/364* (2014.10); *B42D 25/373* (2014.10); *B42D 25/378* (2014.10); *B42D 25/455* (2014.10); *B42D 25/46* (2014.10); *B42D 25/47* (2014.10); *B42D 25/00* (2014.10); *B42D 25/29* (2014.10); *B42D 2033/16* (2013.01); *B42D 2033/20* (2013.01); *B42D 2033/26* (2013.01); *B42D 2035/34* (2013.01); *B42D 2035/50* (2013.01)

(56) References Cited

U.S. PATENT DOCUMENTS

| | | | | |
|---|---|---|---|---|
| 4,652,015 | A | 3/1987 | Crane | |
| 4,705,300 | A | 11/1987 | Berning et al. | |
| 4,705,356 | A | 11/1987 | Berning et al. | |
| 4,721,271 | A | 1/1988 | Goldstein et al. | |
| 4,756,557 | A | 7/1988 | Kaule et al. | |
| 4,838,648 | A | 6/1989 | Phillips et al. | |
| 4,897,300 | A | 1/1990 | Boehm | |
| 5,068,008 | A | 11/1991 | Crane | |
| 5,074,914 | A | 12/1991 | Shirota et al. | |
| 5,084,351 | A | 1/1992 | Philips et al. | |
| 5,211,877 | A | 5/1993 | Andrejewski et al. | |
| 5,214,530 | A | 5/1993 | Coombs et al. | |
| 5,281,480 | A | 1/1994 | Phillips et al. | |
| 5,324,079 | A | 6/1994 | Kaule et al. | |
| 5,362,315 | A | 11/1994 | Müller-Rees et al. | |
| 5,383,995 | A | 1/1995 | Phillips et al. | |
| 5,569,535 | A | 10/1996 | Phillips et al. | |
| 5,571,624 | A | 11/1996 | Phillips et al. | |
| 5,997,622 | A | 12/1999 | Weber et al. | |
| 6,001,161 | A | 12/1999 | Evans et al. | |
| 6,410,130 | B1 | 6/2002 | Schuhmacher et al. | |
| 6,423,246 | B1 | 7/2002 | Kasch et al. | |
| 6,531,221 | B1 | 3/2003 | Schuhmacher et al. | |
| 6,549,131 | B1 | 4/2003 | Cote et al. | |
| 6,582,781 | B1 | 6/2003 | Schuhmacher et al. | |
| 6,732,961 | B2 | 5/2004 | Leigeber et al. | |
| 6,759,097 | B2 | 7/2004 | Phillips et al. | |
| 6,838,166 | B2 | 1/2005 | Phillips et al. | |
| 8,025,952 | B2 | 9/2011 | Raksha et al. | |
| 8,343,615 | B2 | 1/2013 | Raksha et al. | |
| 2002/0160194 | A1* | 10/2002 | Phillips | B42D 25/29 428/403 |
| 2007/0190298 | A1* | 8/2007 | Hampden-Smith | B42D 25/29 428/204 |
| 2007/0241553 | A1 | 10/2007 | Heim et al. | |
| 2011/0095518 | A1 | 4/2011 | Hoffmuller et al. | |
| 2012/0091701 | A1* | 4/2012 | Krueger | C09D 7/69 283/72 |
| 2013/0084411 | A1 | 4/2013 | Raksha et al. | |
| 2014/0300096 | A1* | 10/2014 | Cote | B42D 25/355 283/82 |

FOREIGN PATENT DOCUMENTS

| | | | | |
|---|---|---|---|---|
| EP | 0021350 | | 1/1981 | |
| EP | 0185396 | | 6/1986 | |
| EP | 0303725 | | 2/1989 | |
| EP | 0310707 | | 4/1989 | |
| EP | 0319157 | | 6/1989 | |
| EP | 0518740 | | 12/1992 | |
| EP | 0601483 | | 6/1994 | |
| EP | 0608078 | | 7/1994 | |
| EP | 0635431 | | 1/1995 | |
| EP | 0656607 | | 6/1995 | |
| EP | 0686675 | | 2/1998 | |
| EP | 1046692 | | 10/2000 | |
| EP | 1213338 | | 6/2002 | |
| EP | 1498545 | | 1/2005 | |
| EP | 1666546 | | 6/2006 | |
| EP | 1710756 | | 10/2006 | |
| EP | 1806238 | | 7/2007 | |
| EP | 1819525 | | 3/2010 | |
| EP | 2165774 | | 3/2010 | |
| EP | 2263806 | | 12/2010 | |
| EP | 2263807 | | 12/2010 | |
| EP | 2306222 | | 4/2011 | |
| EP | 2325677 | | 5/2011 | |
| EP | 1497141 | | 9/2011 | |
| EP | 2402401 | | 1/2012 | |
| EP | 2465701 | | 6/2012 | |
| EP | 2465701 | A2 * | 6/2012 | B42D 25/30 |
| EP | 1878773 | | 8/2012 | |
| EP | 1674282 | | 6/2013 | |
| JP | 62190272 | | 8/1987 | |
| JP | 63218766 | | 9/1988 | |
| JP | 02080470 | | 3/2002 | |
| JP | 2007148074 | | 6/2007 | |
| WO | 1990008367 | | 7/1990 | |
| WO | 1992011142 | | 7/1992 | |
| WO | 1996004143 | | 2/1996 | |
| WO | 1996039685 | | 12/1996 | |
| WO | 1998019866 | | 5/1998 | |
| WO | 2002073250 | | 9/2002 | |
| WO | 2003000801 | | 1/2003 | |
| WO | 2004007095 | | 1/2004 | |
| WO | 2004048120 | | 6/2004 | |
| WO | 2006063926 | | 6/2006 | |
| WO | 2007131833 | | 11/2007 | |
| WO | 2008083894 | | 7/2008 | |
| WO | 2011092502 | | 8/2011 | |
| WO | 2012104098 | | 8/2012 | |
| WO | 2014019163 | | 2/2014 | |

OTHER PUBLICATIONS

Chem. Rev. 99 (1999) G. Pfaff and P. Reynders pp. 1963-1981.

"Chemistry & Technology of UV & EB Formulation for Coatings Inks & Paints" published in 7 volumes in 1997-1998 by John Wiley & Sons in association with SITA Technology Limited.

Photoinitiators for Free Radical Cationic and Anionic Polymerization 2nd edition by J. V. Crivello & K. Dietliker edited by G. Bradley and published in 1998 by John Wiley & Sons in association with SITA Technology Limited.

"Chemistry & Technology of UV & EB Formulation for Coatings Inks & Paints" vol. III.

The Printing ink manual R.H. Leach and R.J. Pierce Springer Edition 5th Edition pp. 58-62.

Printing Technology J.M. Adams and P.A. Dolin Delmar Thomson Learning 5th Edition pp. 293-328.

"Handbook of print media" Helmut Kipphan Springer Edition p. 48.

The Printing ink manual R.H. Leach and R.J. Pierce Springer Edition 5th Edition pp. 42-51.

Printing Technology J. M. Adams and P.A. Dolin Delmar Thomson Learning 5th Edition pp. 359-360.

The Printing ink manual R.H. Leach and R.J. Pierce Springer Edition 5th Edition pp. 33-42.

The Printing ink manual R.H. Leach and R.J. Pierce Springer Edition 5th Edition p. 74.

Optical Document Security R. L. van Renesse 2005 3rd Edition pp. 115-117.

International Search Report and Written Opinion issued with respect to application No. PCT/EP2015/063559.

(56) References Cited

OTHER PUBLICATIONS

Chinese office action and Search Report in counterpart Chinese Application No. 201580036781.2 dated Dec. 4, 2017 (and English language translation of Office Action).

* cited by examiner

OPTICALLY VARIABLE MAGNETIC SECURITY THREADS AND STRIPES

FIELD OF THE INVENTION

The present invention relates to the field of the protection of value documents and value commercial goods against counterfeit and illegal reproduction. In particular, the present invention related to the field of security threads or stripes to be incorporated into or onto security documents and security documents comprising said security threads or stripes.

BACKGROUND OF THE INVENTION

With the constantly improving quality of color photocopies and printings and in an attempt to protect security documents such as banknotes, value documents or cards, transportation tickets or cards, tax banderols, and product labels against counterfeiting, falsifying or illegal reproduction, it has been the conventional practice to incorporate various security means in these documents. Typical examples of security means include security threads or stripes, windows, fibers, planchettes, foils, decals, holograms, watermarks, security inks comprising optically variable pigments, magnetic or magnetizable thin film interference pigments, interference-coated particles, thermochromic pigments, photochromic pigments, luminescent, infrared-absorbing, ultraviolet-absorbing or magnetic compounds.

Security threads embedded in the substrate are known to those skilled in the art as an efficient means for the protection of security documents and banknotes against imitation. Reference is made to U.S. Pat. No. 0,964,014; U.S. Pat. No. 4,652,015; U.S. Pat. No. 5,068,008; U.S. Pat. No. 5,324,079; WO 90/08367 A1; WO 92/11142 A1; WO 96/04143 A1; WO 96/39685 A1; WO 98/19866 A1; EP 0 021 350 A1; EP 0 185 396; EP 0 303 725; EP 0 319 157 A1; EP 0 518 740 A1; EP 0 608 078 A1; EP 0 635 431 A1; and EP 1 498 545 A1 as well as the references cited therein.

A security thread is a metal or plastic filament, which is incorporated during the manufacturing process into the substrate serving for printing security documents or banknotes. Security threads or stripes carry particular security elements, serving for the public- and/or machine-authentication of the security document, in particular for banknotes. Common types of security thread include metal-formed characters or indicia disposed on a plastic substrate. Such threads, which are coated with a very thin layer of metal, such as aluminum, and then demetalized, either display discrete metal characters or negative or reverse-image characters. With the aim of further increasing the resistance against counterfeit or illegal reproduction of security threads, it has been a practice to incorporate additional security features within the structure of said threads. Security features, e.g. for security documents, can generally be classified into "covert" security features on the one hand, and "overt" security features on the other hand. The protection provided by covert security features relies on the concept that such features are difficult to detect, typically requiring specialized equipment and knowledge for detection, whereas "overt" security features rely on the concept of being easily detectable with the unaided human senses, e.g. such features may be visible and/or detectable via the tactile senses while still being difficult to produce and/or to copy. Typical examples of additional security features for security threads include optically variable materials, luminescent materials, IR absorbing materials and magnetic materials.

WO 2004/048120 discloses security elements comprising at least two adjacent regions, wherein one of the regions is an optically variable layer and the other region has a layer of material with constant reflection. The disclosed security element comprises regions forming areas without material in order to form graphic makings, characters and the like that can be detected visually.

U.S. 2007/0241553 discloses security elements for securing valuable articles having an optically variable layer that imparts different color impressions at different viewing angles and, in a covering area, a semi-transparent ink layer disposed on top of the optically variable layer, the color impression of the optically variable layer being coordinated with the color impression of the semi-transparent ink layer in the covering area when viewed under predefined viewing conditions.

U.S. 2011/0095518 discloses security elements for securing valuable articles comprising a stacked layer made of an optically variable layer that conveys different color impressions at different viewing angles, and a color-constant layer comprising an ink layer and a metal layer. The optically variable layer and the color-constant layer are stacked in a covering region, while at most one of the optically variable layer and the color-constant layer is present outside the covering region. The color impression of the stacked layers in the covering region and the color impression of the one layer outside the covering region are matched with each other when viewed at a predetermined viewing angle.

EP 2 465 701 A2 discloses security elements for securing valuable articles comprising a stacked layer made of an optically variable layer that conveys different color impressions at different viewing angles, a first portion with a first color-constant impression and a second portion with a color-constant impression and an individualizing marking. The optically variable layer and the two portions exhibiting two color-constant impressions are stacked in a covering region. The disclosed different layers are coordinated so that the color impression of the optically variable layer matches at a predetermined first viewing angle the color impression of the first portion and that the color impression of the optically variable layer matches at a predetermined second viewing angle being different from the first viewing angle the color impression of the second portion.

Magnetic materials have been used as machine readable security features in security threads. Unfortunately, these materials have a degree of inherent color, which renders them visually detectable in reflected or transmission light through a surface of a security paper. Attempts have therefore been made to hide or conceal these materials. While magnetic regions are not visually discernable, the counterfeiter will not be able to reproduce them and therefore the counterfeiting will fail and/or will be easily detected.

CA 2,076,532 C discloses security threads comprising a metallic layer with recesses in the form of characters or patterns and magnetic areas in regions which do not comprise the metallic layer. The magnetic areas of the security threads described in CA 2,076,532 C are not visible by being hidden by the metallic layer.

EP 0 310 707 A2 discloses security threads or stripes comprising magnetically detectable and readable anti-forgery and/or anti-fraud means. The disclosed security threads or stripes comprise mutually spaced magnetic regions obtained with a deposition of magnetic material such as for example magnetic iron oxide. EP 0 310 707 A2 further discloses that a masking layer may be further added so as to hide the magnetic regions from view and thus prevent the fraudulent tampering or reproduction of said regions.

U.S. Pat. No. 6,549,131 discloses methods for camouflaging or burying magnetic machine readable information by using one or more metalized foil layers.

However, the incorporation of a metalized layer to hide the magnetic areas may result in the deterioration of the security thread or stripe upon use and time due to the potential corrosion of the metalized layer. To overcome such a deterioration, additional layers acting as corrosion resistant layers may generally be used.

EP 1 497 141 B1 discloses security substrates comprising a transparent polymer carrier layer bearing indicia formed from a plurality of metalized and demetalized and a clear and transparent magnetic layer, wherein said magnetic layer contains particles of a soft magnetic material of a size in a concentration and size distribution at which the magnetic layer remains clear and transparent.

However, the combination of magnetic layers with metalized layers as well as hiding layers and corrosion resistant layers lead to highly thick security threads which may cause difficulties during the integration of said threads in paper.

There remains a need for sophisticated machine readable security threads or stripes combining a high resistance against counterfeiting or illegal reproduction of security documents comprising said security threads or stripes with a machine readable magnetic code which is not visually detectable in the absence of an additional hiding layer. Said security threads or stripe could thus make impossible the reproduction of said security threads or stripes without knowing in advance said magnetic code while said security threads or stripes have a thickness allowing their incorporation in/on a security document such as banknote.

SUMMARY

There are disclosed and claims herein security threads or stripes and processes for making theses security threads or stripes, the security threads or stripes comprising:

i) an optically variable layer imparting a different color impression at different viewing angles and being made of an optically variable composition comprising optically variable pigment particles;

ii) a magnetic code made of a magnetic composition comprising pigment particles, said pigment particles comprising a magnetic core surrounded by a layer made of one or more inorganic materials, and iii) a non-metallized substrate, wherein the magnetic code has a color matching the color impression of the optically variable layer at one viewing angle, and wherein the optically variable layer and the magnetic code are jointly visible from one side of the security thread or stripe.

Also described and claimed therein are uses of the security threads or stripes for the protection of a security document against counterfeiting or fraud and security documents comprising the security threads or stripes described herein.

Also described and claimed therein are processes for making the security threads or stripes described herein and security threads or stripes obtained thereof.

The security threads or stripes described herein are highly resistant against counterfeiting and illegal reproduction since the magnetic code is not easily distinguishable and identifiable by a counterfeiter. Consequently, such a counterfeiter would fail. Since the magnetic code is fully integrated in the design of the security thread or stripe by having not only a non-dark color as it is the case for conventional machine readable magnetic code but also by fulfilling a color matching at one viewing angle with the optically variable layer, there is no specific need to hide it by one or more hiding layers and a metalized layer. Moreover, by matching the color impression of the optically variable layer at one viewing angle, a potential counterfeiting will not be motivated to further analyze the security thread or stripe in terms of machine readability features. Therefore, the security threads or stripes described herein are highly resistant against counterfeit and illegal reproduction by simultaneously providing overt and covert functionalities, are resistant against deterioration upon use, time and exposure to environment and have a reduced thickness thus allowing the manufacture of said security threads or stripes with more freedom in the design and an easier incorporation in or on a banknote.

DETAILED DESCRIPTION

Figure 1A:
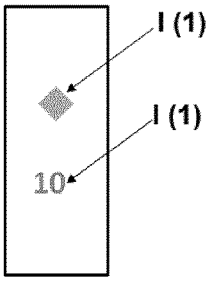
FIG. 1A-B schematically illustrate coatings consisting of indicia.

The following definitions are to be used to interpret the meaning of the terms discussed in the description and recited in the claims.

As used herein, the article "a" indicates one as well as more than one and does not necessarily limit its referent noun to the singular.

As used herein, the term "about" means that the amount or value in question may be the value designated or some other value about the same. The phrase is intended to convey that similar values within a range of ±5% of the indicated value promote equivalent results or effects according to the invention.

As used herein, the term and/or means that either all or only one of the elements of said group may be present. For example, "A and/or B" shall mean "only A, or only B, or both A and B".

The term "composition" refers to any composition which is capable of forming a coating on a solid substrate and which can be applied preferentially but not exclusively by a printing method.

As used herein, the term "indicia" shall mean discontinuous layers such as patterns, including without limitation symbols, alphanumeric symbols, motifs, letters, words, numbers, logos and drawings.

A thread or stripe consists of an elongated security element. By "elongated", it is meant that the dimension of the security element in the longitudinal direction is more than twice as large as its dimension in the transverse direction. Preferably, the security thread or stripe according to the present invention has a width, i.e. dimension in the transverse direction, between about 0.5 mm and about 30 mm, more preferably between about 0.5 mm and about 5 mm. Preferably, the security thread or stripe according to the present invention has a thickness between about 10 and about 60 microns.

As used herein, the term "pigment" is to be understood according to the definition given in DIN 55943: 1993-11 and DIN EN 971-1: 1996-09. Pigments are materials in powder or flake form which are—contrary to dyes—not soluble in the surrounding medium.

As used herein, the terms "match" or "matched" is to be understood to mean that two color impressions substantially appear to be visually identical.

The authenticity of the security threads or stripes described herein may be safely verified by using any suitable banknote processing equipment. Moreover, the security thread or stripe described herein combines different color areas that, under predefined viewing conditions, seem very similar or identical and that seem different when the security thread or stripe is tilted thus conferring a high counterfeit or illegal reproduction resistance.

The security threads or stripes described herein comprise an optically variable layer imparting a different color impression at different viewing angles and being made of an optically variable composition comprising optically variable pigment particles.

Optically variable elements are known in the field of security printing. Optically variable elements (also referred in the art as goniochromatic elements or colorshifting elements) exhibit a viewing-angle or incidence-angle dependent color, and are used to protect banknotes and other security documents against counterfeiting and/or illegal reproduction by commonly available color scanning, printing and copying office equipment. The optically variable layer described herein imparts a different color impression at different viewing angles By "different color impression", it is meant that the element exhibits a difference of at least one parameter of the CIELAB(1976) system, preferably exhibits a different "a*" value, a different "L*" value or a different "b*" value or exhibits two or three different values chosen among "a*", "b*" and "L" values at different viewing angles. On the contrary to optically variable layers that exhibit different colors or color impressions upon variation of the viewing angle, color constant layers consist of layers that do not exhibit a color change or color impression change upon variation of the viewing angle.

For example, layers or coatings comprising optically variable pigment particles exhibit a colorshift upon variation of the viewing angle (e.g. from a viewing angle of about 90° with respect to the plane of the layer or coating to a viewing angle of about 22.5° with respect to the plane of the layer or coating) from a color impression CI1 (e.g. gold) to a color impression CI2 (green). In addition to the overt security provided by the colorshifting property which allows an easy detection, recognition and/or discrimination of the security threads or stripes described herein from their possible counterfeits with the unaided human senses, the colorshifting property may be used as a machine readable tool for the recognition of the security threads or stripes. Thus, the colorshifting properties may simultaneously be used as a covert or semi-covert security feature in an authentication process wherein the optical (e.g. spectral) properties of the security thread or stripe are analyzed. Thus, the colorshifting properties of optically variable layers may simultaneously be used as a covert or semi-covert security feature in an authentication process wherein the optical (e.g. spectral) properties of the layer are analyzed.

According to one embodiment of the present invention and provided that the optically variable layer and the magnetic code are jointly visible from one side of the security thread or stripe, the optically variable layer described herein is a continuous layer. According to another embodiment, and provided that the optically variable layer and the magnetic code are jointly visible from one side of the security thread or stripe, the optically variable layer described herein is a discontinuous layer and comprises one or more gaps in the form of indicia or consists of indicia made of the optically variable composition.

The layers making up the security thread or stripe may be such that the optically variable layer and the magnetic code can be viewed simultaneously from the one side and appear identical at a first viewing angle and yet at a different viewing angle optical variation in the optically variable layer allows the magnetic code and the optically variable layer to be contrasted with the naked eye.

Figure 1B:
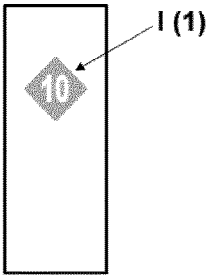
Figure 1C:
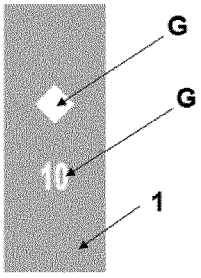
FIG. 1C schematically illustrates gaps in the form of indicia.

As shown in FIGS. 1A and 1B and when the optically variable layer (1) consist of indicia I (1), one or more regions lacking the optically variable layer (1) surrounds said indicia. As shown in FIG. 1B and when the optically variable layer (1) consist of indicia I (1)), said indicia may comprise one or more material-free regions ("10" in FIG. 1B) within said layer (I(1)).

As shown in FIG. 10 and when the optically variable layer (1) comprise one or more gaps (G in FIG. 10) in the form of indicia, said gaps consist of regions lacking the optically variable layer (1). The optically variable layer (1), when comprising one or more gaps G in the form of indicia, comprises material-free areas in the form of indicia. In other words, the optically variable layer (1) (when comprising one or more gaps in the form of indicia) described herein comprises negative writing in the form of indicia. As used herein, the term "negative writing" refers to material-free areas in an otherwise continuous layer.

Preferably, the indicia described herein are independently selected from the group consisting of symbols, alphanumeric symbols, motifs, geometric patterns, letters, words, numbers, logos, drawings and combinations thereof.

The optically variable layer described herein is made of an optically variable composition comprising optically variable pigment particles in an amount from about 2 to about 40 wt-%, preferably from about 10 to about 35 wt-%, the weight percents being based on the total weight of the optically variable composition. The optically variable pigment particles are preferably selected from the group consisting of thin film interference pigments, magnetic thin film interference pigments, interference coated pigments, cholesteric liquid crystal pigments, magnetic cholesteric liquid crystal pigments and mixtures thereof.

According to one embodiment of the present invention, the optically variable layer is made of an optically variable composition comprising non-magnetic optically variable pigments which are preferably selected from the group consisting of thin film interference pigments, interference coated pigments, cholesteric liquid crystal pigments and mixtures thereof.

According to one embodiment of the present invention and with the aim of increasing the complexity of the magnetic code of the security thread or stripe described herein, the optically variable layer may be made of an optically variable composition comprising magnetic optically variable pigment particles which are preferably selected from the group consisting of magnetic thin film interference pigments, magnetic cholesteric liquid crystal pigments and mixtures thereof, provided that the magnetic properties of the optically variable layer comprising the magnetic optically variable pigments are different from the magnetic properties of the magnetic code comprising the pigment particles comprising the magnetic core and a layer made of one or more inorganic materials described herein.

Suitable thin-film interference pigments exhibiting optically variable characteristics are known to those skilled in the art and disclosed in U.S. Pat. No. 4,705,300; U.S. Pat. No. 4,705,356; U.S. Pat. No. 4,721,271; U.S. Pat. No. 5,084,351; U.S. Pat. No. 5,214,530; U.S. Pat. No. 5,281,480; U.S. Pat. No. 5,383,995; U.S. Pat. No. 5,569,535, U.S. Pat. No. 5,571,624 and in the documents related to these. When at least a part of the optically variable pigment particles is constituted by thin film interference pigments, it is preferred that the thin film interference pigments comprise a Fabry-Perot reflector/dielectric/absorber multilayer structure and more preferably a Fabry-Perot absorber/dielectric/reflector/dielectric/absorber multilayer structure, wherein the absorber layers are partially transmitting and partially reflecting, the dielectric layers are transmitting and the reflective layer is reflecting the incoming light. Preferably, the reflector layer is made from one or more materials selected from the group consisting of metals, metal alloys and combinations thereof, preferably selected from the group consisting of reflective metals, reflective metal alloys and combinations thereof and more preferably selected from the group consisting of aluminum (Al), chromium (Cr), nickel (Ni), and mixtures thereof and still more preferably aluminum (Al). Preferably, the dielectric layers are independently made of one or more materials selected from the group consisting of magnesium fluoride ($MgF_2$), silicium dioxide ($SiO_2$) and mixtures thereof and more preferably magnesium fluoride ($MgF_2$). Preferably, the absorber layers are independently made of one or more materials selected from the group consisting of chromium (Cr), nickel (Ni), metallic alloys and mixtures thereof and more preferably chromium (Cr). When at least a part of the optically variable pigment particles is constituted by thin film interference pigments, it is particularly preferred that the thin film interference pigments comprise a Fabry-Perot absorber/dielectric/reflector/dielectric/absorber multilayer structure consisting of a Cr/Mg $F_2$/Al/Mg $F_2$/Cr multilayer structure.

Magnetic thin film interference pigment particles are known to those skilled in the art and are disclosed e.g. in U.S. Pat. No. 4,838,648; WO 2002/073250 A2; EP 0 686 675 B1; WO 2003/000801 A2; U.S. Pat. No. 6,838,166; WO 2007/131833 A1; EP 2 402 401 A1 and in the documents cited therein. Preferably, the magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure.

Preferred five-layer Fabry-Perot multilayer structures consist of absorber/dielectric/reflector/dielectric/absorber multilayer structures wherein the reflector and/or the absorber is also a magnetic layer, preferably the reflector and/or the absorber is a magnetic layer comprising nickel, iron and/or cobalt, and/or a magnetic alloy comprising nickel, iron and/or cobalt and/or a magnetic oxide comprising nickel (Ni), iron (Fe) and/or cobalt (Co).

Preferred six-layer Fabry-Perot multilayer structures consist of absorber/dielectric/reflector/magnetic/dielectric/absorber multilayer structures.

Preferred seven-layer Fabry Perot multilayer structures consist of absorber/dielectric/reflector/magnetic/reflector/dielectric/absorber multilayer structures such as disclosed in U.S. Pat. No. 4,838,648.

Preferably, the reflector layers described herein are independently made from one or more materials selected from the group consisting of metals and metal alloys, preferably selected from the group consisting of reflective metals and reflective metal alloys, more preferably selected from the group consisting of aluminum (Al), silver (Ag), copper (Cu), gold (Au), platinum (Pt), tin (Sn), titanium (Ti), palladium (Pd), rhodium (Rh), niobium (Nb), chromium (Cr), nickel (Ni), and alloys thereof, even more preferably selected from the group consisting of aluminum (Al), chromium (Cr), nickel (Ni) and alloys thereof, and still more preferably aluminum (Al). Preferably, the dielectric layers are independently made from one or more materials selected from the group consisting of metal fluorides such as magnesium fluoride ($MgF_2$), aluminum fluoride ($AlF_3$), cerium fluoride ($CeF_3$), lanthanum fluoride ($LaF_3$), sodium aluminum fluorides (e.g. $Na_3AlF_6$), neodymium fluoride ($NdF_3$), samarium fluoride ($SmF_3$), barium fluoride ($BaF_2$), calcium fluoride ($CaF_2$), lithium fluoride (LiF), and metal oxides such as silicium oxide (SiO), silicium dioxide ($SiO_2$), titanium oxide ($TiO_2$), aluminum oxide ($Al_2O_3$), more preferably selected from the group consisting of magnesium fluoride ($MgF_2$) and silicium dioxide ($SiO_2$) and still more preferably magnesium fluoride ($MgF_2$). Preferably, the absorber layers are independently made from one or more materials selected from the group consisting of aluminum (Al), silver (Ag), copper (Cu), palladium (Pd), platinum (Pt), titanium (Ti), vanadium (V), iron (Fe) tin (Sn), tungsten (W), molybdenum (Mo), rhodium (Rh), Niobium (Nb), chromium (Cr), nickel (Ni), metal oxides thereof, metal sulfides thereof, metal carbides thereof, and metal alloys thereof, more preferably selected from the group consisting of chromium (Cr), nickel (Ni), metal oxides thereof, and metal alloys thereof, and still more preferably selected from the group consisting of chromium (Cr), nickel (Ni), and metal alloys thereof. Preferably, the magnetic layer comprises nickel (Ni), iron (Fe) and/or cobalt (Co); and/or a magnetic alloy comprising nickel (Ni), iron (Fe) and/or cobalt (Co); and/or a magnetic oxide comprising nickel (Ni), iron (Fe) and/or cobalt (Co). When magnetic thin film interference pigment particles comprising a seven-layer Fabry-Perot structure are preferred, it is particularly preferred that the magnetic thin film interference pigment particles comprise a seven-layer Fabry-Perot absorber/dielectric/reflector/magnetic/reflector/dielectric/absorber multilayer structure consisting of a Cr/$MgF_2$/Al/Ni/Al/$MgF_2$/Cr multilayer structure.

The magnetic thin film interference pigment particles described herein may be multilayer pigment particles being considered as safe for human health and the environment and being based for example on five-layer Fabry-Perot multilayer structures, six-layer Fabry-Perot multilayer structures and seven-layer Fabry-Perot multilayer structures, wherein said pigment particles include one or more magnetic layers comprising a magnetic alloy having a substantially nickel-free composition including about 40 wt-% to about 90 wt-% iron, about 10 wt-% to about 50 wt-% chromium and about 0 wt-% to about 30 wt-% aluminum. Typical examples of multilayer pigment particles being considered as safe for human health and the environment can be found in EP 2 402 401 A1 which is hereby incorporated by reference in its entirety.

Thin film interference pigment particles and magnetic thin film interference pigment particles described herein are typically manufactured by a conventional deposition technique of the different required layers onto a web. After deposition of the desired number of layers, e.g. by physical vapor deposition (PVD), chemical vapor deposition (CVD) or electrolytic deposition, the stack of layers is removed from the web, either by dissolving a release layer in a suitable solvent, or by stripping the material from the web. The so-obtained material is then broken down to flakes which have to be further processed by grinding, milling (such as for example jet milling processes) or any suitable method so as to obtain pigment particles of the required size. The resulting product consists of flat flakes with broken edges, irregular shapes and different aspect ratios. Further information on the preparation of suitable pigment particles can be found e.g. in EP 1 710 756 A1 and EP 1 666 546 A1 which are hereby incorporated by reference.

Suitable interference coated pigments include without limitation structures consisting of a non-magnetic material selected from the group consisting of metallic cores such as titanium, silver, aluminum, copper, chromium, germanium, molybdenum or tantalum coated with one or more layers made of metal oxides as well as structures consisting of a core made of synthetic or natural micas, other layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures thereof coated with one or more layers made of metal oxides (e.g. titanium oxides, zirconium oxides, tin oxides, chromium oxides, nickel oxides and copper oxides), the structures described hereabove have been described for example in Chem. Rev. 99 (1999), G. Pfaff and P. Reynders, pages 1963-1981 and WO 2008/083894. Typical examples of these interference coated pigments include without limitation silicium oxide cores coated with one or more layers made of titanium oxide and/or tin oxide; natural or synthetic mica cores coated with one or more layers made of titanium oxide and/or, silicium oxide, in particular mica cores coated with alternate layers made of silicium oxide and titanium oxide; borosilicate cores coated with one or more layers made of titanium oxide, silicium oxide and/or tin oxide; and titanium oxide cores coated with one or more layers made of chromium oxide, copper oxide, cerium oxide, aluminum oxide, silicium oxide, bismuth vanadate, nickel titanate, cobalt titanate and/or antimony-doped, fluorine-doped or indium-doped tin oxide; aluminum oxide cores coated with one or more layers made of titanium oxide.

Liquid crystals in the cholesteric phase exhibit a molecular order in the form of a helical superstructure perpendicular to the longitudinal axes of its molecules. The helical superstructure is at the origin of a periodic refractive index modulation throughout the liquid crystal material, which in turn results in a selective transmission/reflection of determined wavelengths of light (interference filter effect). Cholesteric liquid crystal polymers can be obtained by subjecting one or more crosslinkable substances (nematic compounds) with a chiral phase to alignment and orientation. The particular situation of the helical molecular arrangement leads to cholesteric liquid crystal materials exhibiting the property of reflecting a circularly polarized light component within a determined wavelength range. The pitch (i.e. the distance over which a full rotation of 360° of the helical arrangement is completed) can be tuned in particular by varying selectable factors including the temperature and solvents concentration, by changing the nature of the chiral component(s) and the ratio of nematic and chiral compounds. Crosslinking under the influence of UV radiation freezes the pitch in a predetermined state by fixing the desired helical form so that the color of the resulting cholesteric liquid crystal materials is no longer depending on external factors such as the temperature. Cholesteric liquid crystal materials may then be shaped to cholesteric liquid crystal pigments by subsequently comminuting the polymer to the desired particle size. Examples of films and pigments made from cholesteric liquid crystal materials and their preparation are disclosed in U.S. Pat. No. 5,211,877; U.S. Pat. No. 5,362,315 and U.S. Pat. No. 6,423,246 and in EP 1 213 338 A1; EP 1 046 692 A1 and EP 0 601 483 A1, the respective disclosure of which is incorporated by reference herein.

Suitable magnetic cholesteric liquid crystal pigment particles exhibiting optically variable characteristics include without limitation magnetic monolayered cholesteric liquid crystal pigment particles and magnetic multilayered cholesteric liquid crystal pigment particles. Such pigment particles are disclosed for example in WO 2006/063926 A1, U.S. Pat. No. 6,582,781 and U.S. Pat. No. 6,531,221. WO 2006/063926 A1 discloses monolayers and pigment particles obtained therefrom with high brilliance and colorshifting properties with additional particular properties such as magnetizability. The disclosed monolayers and pigment particles, which are obtained therefrom by comminuting said monolayers, include a three-dimensionally crosslinked cholesteric liquid crystal mixture and magnetic nanoparticles. U.S. Pat. No. 6,582,781 and U.S. Pat. No. 6,410,130 disclose platelet-shaped cholesteric multilayer pigment particles which comprise the sequence $A^1/B/A^2$, wherein $A^1$ and $A^2$ may be identical or different and each comprises at least one cholesteric layer, and B is an interlayer absorbing all or some of the light transmitted by the layers $A^1$ and $A^2$ and imparting magnetic properties to said interlayer. U.S. Pat. No. 6,531,221 discloses platelet-shaped cholesteric multilayer pigment particles which comprise the sequence NB and optionally C, wherein A and C are absorbing layers comprising pigment particles imparting magnetic properties, and B is a cholesteric layer.

The optically variable pigments and magnetic optically variable pigments described herein may be surface treated so as to protect them against any deterioration that may occur in the optically variable composition and/or to facilitate their incorporation in the variable composition; typically corrosion inhibitor materials and/or wetting agents may be used.

The security thread or stripe described herein comprises a magnetic code having a color matching the color impression of the optically variable layer at one viewing angle. The magnetic code is made of a magnetic composition as described above that is suitably arranged to form the magnetic code. A magnetic code is characteristic of a security thread or stripe or a security document comprising such a security thread or stripe to be protected and authenticated. The magnetic code described herein comprises non-adjacent magnetic areas (i.e. two, three or more areas of indicia) made of the magnetic composition comprising the core-shell pigment particles described herein and areas free from said magnetic composition, wherein both areas are arranged along a predetermined direction which extends along the longwise direction of the security thread or stripe. In an embodiment, the magnetic areas are arranged as bands extending across the stripe or thread and spaced in the longwise direction of the security thread or stripe, with the spacing forming magnetic composition free bands. The magnetic areas of the magnetic code serve to store information for automatic reading, decoding or recognition by a device that detects magnetic variations on the security thread or stripe.

The magnetic code described herein is made of a magnetic composition comprising pigment particles (herein called "core-shell pigment particles"), said pigment particles comprising a magnetic core and a layer made of one or more inorganic materials, thus conferring not only machine readable magnetic properties of the security threads or stripes described herein but also specific IR properties. In comparison with conventional magnetic codes that are based on IR-absorbing materials, the magnetic composition described herein and the magnetic code described herein advantageously have a diffuse IR reflectance between 800 and 1000 nm which is higher than 60%, preferably higher than 80%, thus conferring an increased barrier against counterfeiting or illegal reproduction since the magnetic code is not rendered visible under an IR camera (i.e. is IR transparent) and a potential counterfeiter is therefore not motivated to counterfeit the magnetic code. Moreover, the use of an IR transparent magnetic code increases the freedom of design of a security document comprising the security thread or stripe described herein by avoiding any interference with any other IR absorbing security element present on the security document.

The magnetic code described herein is made of a magnetic composition comprising pigment particles, said pigment particles comprising a magnetic core and a layer made one or more inorganic materials. Preferably, the magnetic code described herein is made of a magnetic composition comprising the core-shell pigment particles described herein in an amount from about 3 to about 70 wt-%, preferably from about 10 to about 60 and still more preferably from about 20 to about 40 wt-% of, the weight percents being based on the total weight of the magnetic composition.

The magnetic composition described herein comprises the core-shell pigment particles described herein and one or more dyes, preferably in an amount from about 1 to about 70 wt-% and/or one or more of inorganic pigments, organic pigments or mixtures thereof, preferably in an amount from about 0.1 to about 45 wt-%, the weight percents being based on the total weight of the magnetic composition.

Dyes suitable for inks are known in the art. Suitable dyes are IR transparent dyes (i.e. dyes having a diffuse IR reflectance between 800 and 1000 nm which is higher than 60%) and are preferably selected from the group comprising reactive dyes, direct dyes, anionic dyes, cationic dyes, acid dyes, basic dyes, food dyes, metal-complex dyes, solvent dyes and mixtures thereof. Typical examples of suitable dyes include without limitation C.I. Solvent Yellow 79, 81, 82, 88, 89; C.I. Solvent Orange 11, 54, 56, 99; C.I. Solvent Brown 42, 43, 44; C.I. Solvent Red 118, 122, 125, 127, 130, 160, 199, 233; C.I. Solvent Blue 67, 70; C.I. Solvent Black 27, 28, 29; Acid Blue 9, 260, 158; and Reactive Blue 176. Dyes commercially available under the trademark Orasol® Yellow 081, 141, 152, 157, 190; Orasol® Orange 245, 247, 251, RG, 272; Orasol® Brown 322, 324, 326; Orasol® Red 330, 335, 355, 363, 365, 385, 395, 471; Orasol® Pink 478; Orasol® Blue 825, 855, GL; Orasol® Black X45, RLI, X51, X55 may also be used.

Organic and inorganic pigments suitable for inks are known in the art. Suitable organic and inorganic pigments are IR transparent pigments (i.e. dyes having a diffuse IR reflectance between 800 and 1000 nm which is higher than 60%). Typical examples of organic and inorganic pigments suitable for the present invention include without limitation C.I. Pigment Yellow 110, 139, 151; C.I. Pigment Orange 69, 73; C.I. Pigment Red 122, 179, 202, 254, 282; C.I. Pigment Brown 29; C.I. Pigment Violet 19; C.I. Pigment Blue 15:1, 15:2, 15:3, 15:4, 15:6, 60; C.I. Pigment Green 7, 36; and C.I. Pigment Black 31, 32.

Alternatively, non-interference coated pigments may be comprised in the magnetic composition described herein. Typical example of non-interference coated pigments include without limitation structures comprising a core made of synthetic or natural micas and one or more additional layers made of titanium oxide, silicium oxide, iron oxide and/or tin oxide.

The pigment particles comprised in the magnetic composition used to prepare the magnetic code comprises a magnetic core and a layer made of one or more inorganic materials.

The size of the core-shell pigment particles described herein is preferably between about 0.1 and about 30 microns, preferably between about 0.5 and about 15 microns.

The magnetic core described herein is made of a soft-magnetic, semi-hard (12.5-125 Oe) or hard-magnetic type, ideally, but not limited to, 2 to 5000 Oe. The magnetic core described herein preferably comprises a magnetic material selected from the group consisting of magnetic metals (in particular iron, cobalt and nickel); magnetic metal oxides (in particular $Fe_2O_3$, $Fe_3O_4$, $CrO_2$, hexaferrites such as for example barium hexaferrites and strontium hexaferrites, perovskites and $A_3B_5O_{12}$ garnets, wherein A is a trivalent rare earth ion and B is of $Al^{3+}$, $Cr^{3+}$, $Fe^{3+}$, $Ga^{3+}$ or $Bi^{3+}$); magnetic metal alloys (in particular iron alloys, iron-nickel alloys, iron-cobalt alloys, nickel-cobalt alloys, iron-nickel alloy nitrides and iron-nickel-cobalt alloy nitrides) and mixtures or combinations thereof. More preferably, the magnetic core described herein comprises a magnetic material selected from the group consisting of iron, $Fe_2O_3$ and $Fe_3O_4$ and mixtures or combinations thereof.

Preferably, the shape of the magnetic core includes isotropic bodies such as a sphere, nearly spherical shapes, spherical shapes, polyhedrons, acicular bodies, such as obtained by crystallization as well as powders having irregular particle shape such as obtained by grinding a material.

The magnetic core described herein is surrounded by a layer, said layer being made of one or more inorganic materials.

According to one embodiment, the one or more inorganic materials described herein are metals, preferably selected from the group consisting of silver, aluminum, nickel, palladium, platinum, palladium, copper, gold, rhodium, zinc, iridium and their alloys, more preferably selected from the group consisting of silver, aluminum and gold and still more preferably silver.

According to another embodiment, the one or more inorganic materials described herein are metal oxides, preferably selected from the group consisting of MgO and ZnO, $Al_2O_3$, $Y_2O_3$, $Ln_2O_3$ (wherein Ln is a lanthanide), $SiO_2$, $TiO_2$, $ZrO_2$, $CeO_2$ and mixtures thereof), more preferably selected from the group consisting of $SiO_2$, $TiO_2$ and $Y_2O_3$ and mixtures thereof and more still more preferably from $SiO_2$ and $TiO_2$.

According to another embodiment, the one or more inorganic materials described herein are metal sulfides, preferably selected from the group consisting of ZnS; CaS and mixtures thereof.

According to one embodiment the one or more inorganic materials described herein are combinations of metals, metal oxides and metal sulfides such as those described herein.

According to a preferred embodiment, the magnetic core of the pigment particles is surrounded by two or more layers, three or more, four or more layers, such as for example a first layer, a second layer, a third layer, etc.

According to one embodiment, the magnetic core of the pigment particles described herein is surrounded by two layers. According to a preferred embodiment, the magnetic core of the pigment particles described herein is surrounded by a first layer made of the one or more inorganic materials described herein and a second layer made of the one or more inorganic materials, wherein at least one of the first and second layer is made of one or more inorganic materials being metals such as those described herein, preferably selected from the group consisting of silver, aluminum and gold, and wherein the second layer is not made of a same material as the first layer. According to another preferred embodiment, the magnetic core of the pigment particles described herein is surrounded by a first layer made of the one or more inorganic materials described herein and a second layer made of one or more organic materials, wherein the first layer is made of one or more inorganic materials being metals such as those described herein, preferably selected from the group consisting of silver, aluminum and gold. According to another preferred embodiment, the magnetic core of the pigment particles described herein is surrounded by a first layer made of one or more organic materials described herein and a second layer made of one or more inorganic materials, wherein the second layer is made of one or more inorganic materials being metals such as those described herein, preferably selected from the group consisting of silver, aluminum and gold.

According to another embodiment, the magnetic core of the pigment particles described herein is surrounded by three layers. According to a preferred embodiment, the magnetic core of the pigment particles described herein is surrounded by three layers made of the one or more inorganic materials described herein, wherein at least one of the three layers is made of one or more inorganic materials being metals such as those described herein, preferably selected from the group consisting of silver, aluminum and gold and wherein adjacent layers are not made of the same material. According to another preferred embodiment, the magnetic core of the pigment particles described herein is surrounded by a layer made of the one or more inorganic materials described herein, another layer made of the one or more inorganic materials described herein and another layer made of the one or more organic materials described herein, wherein at least one of the inorganic layers is made of one or more inorganic materials being metals such as those described herein, preferably selected from the group consisting of silver, aluminum and gold, and provided that adjacent layers are not made of the same material (for sake of clarity, the sequence described herein is not limited). According to another preferred embodiment, the magnetic core of the pigment particles described herein is surrounded by a layer made of the one or more organic materials described herein, another layer made of the one or more inorganic materials described herein and another layer made of the one or more organic materials described herein, wherein the layer made of the one or more inorganic materials is made of one or more inorganic materials being metals such as those described herein, preferably selected from the group consisting of silver, aluminum and gold, and wherein adjacent layers are not made of the same material (for sake of clarity, the sequence described herein is not limited).

The one or more organic materials described herein are preferably selected from the group consisting of polyacrylates (preferably poly(methyl methacrylate, PMMA), polystyrenes, parylenes, alkoxysilanes (preferably 3-methacryloxypropyl trimethoxysilane, TMP), and combinations thereof. More preferably the one or more organic materials are selected from the group consisting of poly(methyl methacrylate) and 3-methacryloxypropyl trimethoxysilane.

According to a preferred embodiment, the magnetic core described herein of the core-shell pigment particles is surrounded by a first layer and a second layer, wherein the first layer is made of one or more inorganic materials being metals such as those described herein, preferably selected from the group consisting of silver, aluminum and gold and the second layer is made of one or more inorganic materials being metal oxides such as those described hereabove, preferably selected from the group consisting of $SiO_2$, $TiO_2$ and $Y_2O_3$. Preferred examples of such particles include without limitation particles comprising the magnetic core described herein of the core-shell pigment particles surrounded by a first layer made of silver and a second layer made of one or more inorganic materials selected from the group consisting of $SiO_2$, $TiO_2$ and $Y_2O_3$, more preferably selected from the group consisting $SiO_2$ and $TiO_2$.

According to another preferred embodiment, the magnetic core described herein of the core-shell pigment particles is surrounded by a first layer and a second layer, wherein the first layer is made of one or more inorganic materials being metals such as those described herein, preferably selected from the group consisting of silver, aluminum and gold and the second layer is made of one or more one or more organic materials such as those described hereabove. Preferred examples of such particles include without limitation pigment particles comprising the magnetic core described herein surrounded by a first layer made of silver and a second layer made of one or more organic materials selected from the group consisting poly(methyl methacrylate) and 3-methacryloxypropyl trimethoxysilane.

According to another preferred embodiment, the magnetic core described herein of the core-shell pigment particles is surrounded by a first layer and a second layer, wherein the first layer is made of one or more inorganic materials being metal oxides such as those described hereabove, preferably selected from the group consisting of $SiO_2$, $TiO_2$ and $Y_2O_3$ and the second layer is made of one or more inorganic materials being metals such as those described herein, preferably selected from the group consisting of silver, aluminum and gold. Preferred examples of such particles include without limitation particles comprising the magnetic core described herein surrounded by a first layer made of one or more inorganic materials selected from the group consisting of $SiO_2$, $TiO_2$ and $Y_2O_3$, more preferably selected from the group consisting $SiO_2$ and $TiO_2$, and a second layer made of silver.

According to another preferred embodiment, the magnetic core, described herein of the core-shell pigment particles is surrounded by a first layer and a second layer, wherein the first layer is made of one or more one or more organic materials such as those described hereabove and the second layer is made of one or more inorganic materials being metals such as those described herein, preferably selected from the group consisting of silver, aluminum and gold. Preferred examples of such particles include without limitation particles comprising the magnetic core described herein surrounded by a first layer made of one or more organic materials selected from the group consisting poly (methyl methacrylate) and 3-methacryloxypropyl trimethoxysilane and a second layer made of silver.

All suitable deposition processes (physical and/or chemical) can be used to deposit organic layers and inorganic layers onto the magnetic core described herein. Typical examples of deposition processes or coating process include without limitation chemical vapor deposition (CVD) and wet-chemical coating. In the case of forming an organic material layer, these core-shell pigment particles may be prepared by a method consisting of dispersing the magnetic cores described herein in a liquid phase and an organic layer is formed on the particles by emulsion polymerization (liquid-phase polymerization method), or by a method in which the organic layer is formed in a vapor phase (CVD) (PVD), or of still others methods known by the skilled one in the art.

Interesting supplementary pigment properties can be obtained through the deposition of an appropriate outmost layer (i.e. a layer facing the environment) on the core-shell pigment particles, such as surface wetting properties and dispersion properties, which are helpful during the manufacturing of the magnetic composition described herein, thus conferring said composition a stable behavior during storage and during the application process.

In a particularly preferred embodiment, the magnetic composition described herein comprises the core-shell pigment particles described herein, wherein the said particles have a bulk lightness L* higher than 60 according to the CIELAB (1976) scale, preferably higher than 75, most preferably higher than 80.

The security thread or stripe described herein comprises the optically variable layer described herein and the magnetic code described herein. The optically variable layer may be adjacent to the magnetic code or may be spaced apart. By "adjacent", it is meant that the optically variable layer and the magnetic code are in direct contact. By "spaced apart", it is meant that the optically variable layer and the magnetic code are not in direct contact and that a distance less than 50% of the width of the security thread or stripe, preferably between about 5% and 35% of the width of the security thread or stripe, is present between said optically variable layer and said magnetic code.

Figure 2A:
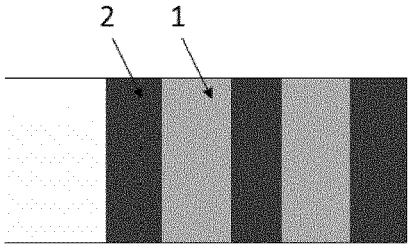
FIG. 2A-C schematically illustrate top views of security threads and stripes according to the present invention.
Figure 2B:
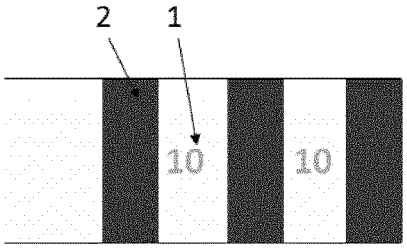
Figure 2C:
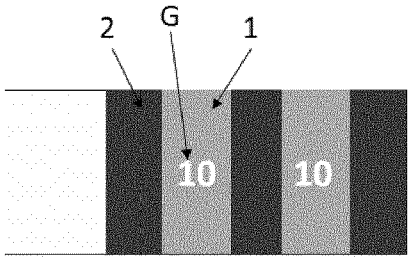

FIG. 2A-C are top views of examples of security threads or stripes described herein, wherein (1) consist of the optically variable layer, (2) consist of the magnetic code, and (G) consists of a gap within the optically variable layer. FIG. 2A-B illustrate security threads or stripes comprising the optically variable layer (1) consisting of indicia made of the optically variable composition described herein (a rectangular pattern in FIG. 2A and a "10" in FIG. 2B). FIG. 2C illustrates a security thread or stripe comprising the optically variable layer (1) comprising one or more gaps in the form of indicia (a "10" in FIG. 2C).

The security thread or stripe described herein comprises a non-metallized substrate. Preferably, the non-metallized substrate is made of one or more plastics or polymers preferably selected form the group consisting of polyolefins (e.g. polyethylene and polypropylene), polyamides, polyesters (e.g. poly(ethylene terephthalate) (PET), poly(1,4-butylene terephthalate) (PBT) and poly(ethylene 2,6-naphthoate) (PEN)), polyvinylchlorides (PVC) and mixtures thereof.

The security thread or stripe described may further comprise a non-magnetic layer made of a non-magnetic composition, said non-magnetic layer having a color matching the color impression of the magnetic code. Typically, the non-magnetic layer described herein is made of a non-magnetic composition comprising one or more dyes, preferably in an amount from about 1 to about 60 wt-%, and/or one or more of inorganic pigments, organic pigments or mixtures thereof, preferably in an amount from about 0.1 to about 45 wt-%, the weight percents being based on the total weight of the non-magnetic composition. The non-magnetic layer may be a color constant layer that does not change with viewing angle. The non-magnetic layer may serve to disguise the magnetic code so that it is no possible to distinguish magnetic areas and magnetic composition free areas making up the magnetic code, irrespective of a viewing angle, with the naked eye.

The non-magnetic layer may be disposed so as to be visible in the magnetic composition free areas from the one side with the naked eye. In this way, size and location of the magnetic areas are not determinable with the naked eye as the naked eye is not able to differentiate the non-magnetic layer and the magnetic areas.

In an embodiment, the non-magnetic layer may be level with the magnetic areas of the magnetic code in the thickness direction so as to be disposed in the magnetic composition free areas. The optically variable layer may be disposed on the substrate side or the opposed side of the level of the magnetic areas and non-magnetic layer disposed therebetween, in the thickness direction of the thread or stripe.

Dyes suitable for the non-magnetic composition described herein are known in the art and are preferably selected from the group comprising reactive dyes, direct dyes, anionic dyes, cationic dyes, acid dyes, basic dyes, food dyes, metal-complex dyes, solvent dyes and mixtures thereof. Typical examples of suitable dyes include without limitation coumarines, cyanines, oxazines, uranines, phtalocyanines, indolinocyanines, triphenylmethanes, naphtalocyanines, indonanaphtalo-metal dyes, anthraquinones, anthrapyridones, azo dyes, rhodamines, squarilium dyes, croconium dyes. Typical examples of dyes suitable for the present invention include without limitation C.I. Acid Yellow 1, 3, 5, 7, 11, 17, 19, 23, 25, 29, 36, 38, 40, 42, 44, 49, 54, 59, 61, 70, 72, 73, 75, 76, 78, 79, 98, 99, 110, 111, 121, 127, 131, 135, 142, 157, 162, 164, 165, 194, 204, 236, 245; C.I. Direct Yellow 1, 8, 11, 12, 24, 26, 27, 33, 39, 44, 50, 58, 85, 86, 87, 88, 89, 98, 106, 107, 110, 132, 142, 144; C.I. Basic Yellow 13, 28, 65; C.I. Reactive Yellow 1, 2, 3, 4, 6, 7, 11, 12, 13, 14, 15, 16, 17, 18, 22, 23, 24, 25, 26, 27, 37, 42; C.I. Food Yellow 3, 4; C.I. Acid Orange 1, 3, 7, 10, 20, 76, 142, 144; C.I. Basic Orange 1, 2, 59; C.I. Food Orange 2; C.I. Orange B; C.I. Acid Red 1, 4, 6, 8, 9, 13, 14, 18, 26, 27, 32, 35, 37, 42, 51, 52, 57, 73, 75, 77, 80, 82, 85, 87, 88, 89, 92, 94, 97, 106, 111, 114, 115, 117, 118, 119, 129, 130, 131, 133, 134, 138, 143, 145, 154, 155, 158, 168, 180, 183, 184, 186, 194, 198, 209, 211, 215, 219, 221, 249, 252, 254, 262, 265, 274, 282, 289, 303, 317, 320, 321, 322, 357, 359; C.I. Basic Red 1, 2, 14, 28; C.I. Direct Red 1, 2, 4, 9, 11, 13, 17, 20, 23, 24, 28, 31, 33, 37, 39, 44, 46, 62, 63, 75, 79, 80, 81, 83, 84, 89, 95, 99, 113, 197, 201, 218, 220, 224, 225, 226, 227, 228, 229, 230, 231, 253; C.I. Reactive Red 1, 2, 3, 4, 5, 6, 7, 8, 11, 12, 13, 15, 16, 17, 19, 20, 21, 22, 23, 24, 28, 29, 31, 32, 33, 34, 35, 36, 37, 38, 39, 40, 41, 42, 43, 45, 46, 49, 50, 58, 59, 63, 64, 108, 180; C.I. Food Red 1, 7, 9, 14; C.I. Acid Blue 1, 7, 9, 15, 20, 22, 23, 25, 27, 29, 40, 41, 43, 45, 54, 59, 60, 62, 72, 74, 78, 80, 82, 83, 90, 92, 93, 100, 102, 103, 104, 112, 113, 117, 120, 126, 127, 129, 130, 131, 138, 140, 142, 143, 151, 154, 158, 161, 166, 167, 168, 170, 171, 182, 183, 184, 187, 192, 193, 199, 203, 204, 205, 229, 234, 236, 249, 254, 285; C.I. Basic Blue 1, 3, 5, 7, 8, 9, 11, 55, 81; C.I. Direct Blue 1, 2, 6, 15, 22, 25, 41, 71, 76, 77, 78, 80, 86, 87, 90, 98, 106, 108, 120, 123, 158, 160, 163, 165, 168, 192, 193, 194, 195, 196, 199, 200, 201, 202, 203, 207, 225, 226, 236, 237, 246, 248, 249; C.I. Reactive Blue 1, 2, 3, 4, 5, 7, 8, 9, 13, 14, 15, 17, 18, 19, 20, 21, 25, 26, 27, 28, 29, 31, 32, 33, 34, 37, 38, 39, 40, 41, 43, 44, 46, 77; C.I. Food Blue 1, 2; C.I. Acid Green 1, 3, 5, 16, 26, 104; C.I.

Basic Green 1, 4; 0.1: Food Green 3; C.I. Acid Violet 9, 17, 90, 102, 121; C.I. Basic Violet 2, 3, 10, 11, 21; C.I. Acid Brown 101, 103, 165, 266, 268, 355, 357, 365, 384; C.I. Basic Brown 1; C.I. Acid Black 1, 2, 7, 24, 26, 29, 31, 48, 50, 51, 52, 58, 60, 62, 63, 64, 67, 72, 76, 77, 94, 107, 108, 109, 110, 112, 115, 118, 119, 121, 122, 131, 132, 139, 140, 155, 156, 157, 158, 159, 191, 194; C.I. Direct Black 17, 19, 22, 32, 39, 51, 56, 62, 71, 74, 77, 94, 105, 106, 107, 108, 112, 113, 117, 118, 132, 133, 146, 154, 168; C.I. Reactive Black 1, 3, 4, 5, 6, 8, 9, 10, 12, 13, 14, 18, 31; C.I. Food Black 2; C.I. Solvent Yellow 19, C.I. Solvent Orange 45, C.I. Solvent Red 8, C.I. Solvent Green 7, C.I. Solvent Blue 7, C.I. Solvent Black 7; C.I. Disperse Yellow 3, C.I. Disperse Red 4, 60, C.I. Disperse Blue 3, and metal azo dyes disclosed in U.S. Pat. No. 5,074,914, U.S. Pat. No. 5,997,622, U.S. Pat. No. 6,001,161, JP 02-080470, JP 62-190272, JP 63-218766.

Typical examples of organic and inorganic pigments suitable for the non-magnetic composition described herein include without limitation C.I. Pigment Yellow 12, C.I. Pigment Yellow 42, C.I. Pigment Yellow 93, 109, C.I. Pigment Yellow 110, C.I. Pigment Yellow 147, C.I. Pigment Yellow 173, C.I. Pigment Orange 34, C.I. Pigment Orange 48, C.I. Pigment Orange 49, C.I. Pigment Orange 61, C.I. Pigment Orange 71 C.I. Pigment Orange 73, C.I. Pigment Red 9, C.I. Pigment Red 22, C.I. Pigment Red 23, C.I. Pigment Red 67, C.I. Pigment Red 122, C.I. Pigment Red 144, C.I. Pigment Red 146, C.I. Pigment Red 170, C.I. Pigment Red 177, C.I. Pigment Red 179, C.I. Pigment Red 185, C.I. Pigment Red 202, C.I. Pigment Red 224, C.I. Pigment Red 242, C.I. Pigment Red 254, C.I. Pigment Red 264, C.I. Pigment Brown 23, C.I. Pigment Blue 15, C.I. Pigment Blue 15:3, C.I. Pigment Blue 60, C.I. Pigment Violet 19, C.I. Pigment Violet 23, C.I. Pigment Violet 32, C.I. Pigment Violet 37, C.I. Pigment Green 7, C.I. Pigment Green 36, C.I. Pigment Black 7, C.I. Pigment Black 11, metal oxides such as titanium dioxide, antimony yellow, lead chromate, lead chromate sulfate, lead molybdate, ultramarine blue, cobalt blue, manganese blue, chrome oxide green, hydrated chrome oxide green, cobalt green and metal sulfides, such as cerium or cadmium sulfide, cadmium sulfoselenides, zinc ferrite, bismuth vanadate, Prussian blue, $Fe_3O_4$, carbon black, mixed metal oxides, azo, azomethine, methine, anthraquinone, phthalocyanine, perinone, perylene, diketopyrrolopyrrole, thioindigo, thiazinindigo, dioxazine, iminoisoindoline, iminoisoindolinone, quinacridone, flavanthrone, indanthrone, anthrapyrimidine and quinophthalone pigments.

Alternatively, non-interference coated pigments may be comprised in the non-magnetic composition described herein. Typical example of non-interference coated pigments include without limitation structures comprising a core made of synthetic or natural micas and one or more additional layers made of titanium oxide, silicium oxide, iron oxide and/or tin oxide.

Figure 3A:
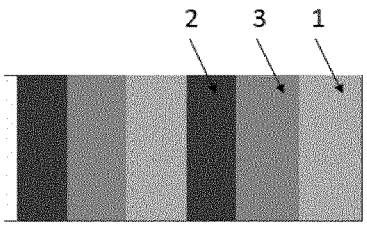
FIG. 3A-B schematically illustrate top views of security threads and stripes according to the present invention.
Figure 3B:
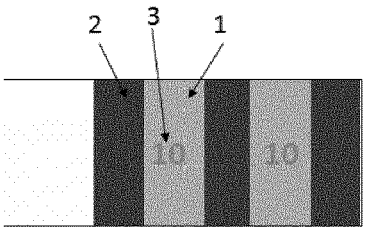

The non-magnetic layer may be continuous or discontinuous provided that the optically variable layer, the magnetic code and the non-magnetic layer are jointly visible from one side of the security thread or stripe. According to one embodiment, and provided that the optically variable layer, the magnetic code and the non-magnetic layer are jointly visible from one side of the security thread or stripe, the non-magnetic layer described herein is a discontinuous layer which may comprise one or more gaps in the form of indicia or consists of indicia made of the non-magnetic composition. FIG. 3A-B are top views of examples of security threads or stripes described herein, wherein (1) consist of the optically variable layer, (2) consist of the magnetic code, and (3) consists of the non-magnetic layer. FIG. 3A illustrates a security thread or stripe comprising the optically variable layer (1) consisting of indicia (a rectangular pattern), the magnetic code (2), and the non-magnetic layer (3) consisting of indicia (a rectangular pattern). FIG. 3B illustrates a security thread or stripe comprising the optically variable layer (1) consisting of indicia (a rectangular pattern), the magnetic code (2) consisting of indicia (a rectangular pattern) and the non-magnetic layer (3) consisting of indicia (a "10"), wherein the non-magnetic layer (3) is surrounded by the optically variable layer (1).

Figure 4A:
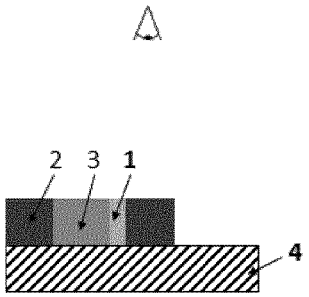
FIG. 4A-C schematically illustrate cross sections of security threads and stripes according to the present invention.
Figure 4B:
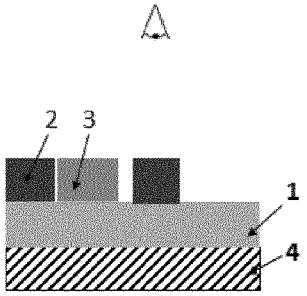
Figure 4C:
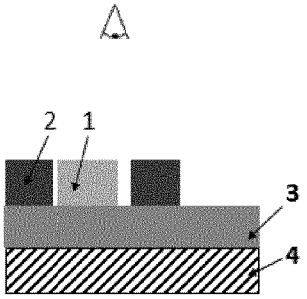

FIG. 4A-C exemplify security threads or stripes further comprising the optically variable layer (1), the magnetic code (2), the non-magnetic layer (3) and the non-metallized substrate (4) described herein.

According to one aspect of the present invention, the optically variable composition described herein and/or the magnetic composition described herein and/or the non-magnetic composition when present consist of thermal drying coating compositions. Thermal drying coating compositions consist of coating compositions of any type of aqueous compositions, solvent-based compositions or compositions comprising water with one or more solvents, said composition being dried by hot air, infrared or by a combination of hot air and infrared. Typical examples of thermal drying coating compositions comprises components including without limitation resins such as polyester resins, polyether resins, vinyl chloride polymers and vinyl chloride based copolymers, nitrocellulose resins, cellulose acetobutyrate or acetopropionate resins, maleic resins, polyamides, polyolefins, polyurethane resins, functionalized polyurethane resins (e.g. carboxylated polyurethane resins), polyurethane alkyd resins, polyurethane-(meth)acrylate resins, urethane-(meth)acrylic resins, styrene (meth)acrylate resins or mixtures thereof. The term "(meth)acrylate" or "(meth) acrylic" in the context of the present invention refers to the acrylate as well as the corresponding methacrylate or refers to the acrylic as well as the corresponding methacrylic. As used herein, the term "solvent-based compositions" refers to compositions whose liquid medium or carrier substantially consists of one or more organic solvents. Examples of such solvents include without limitation alcohols (such as for example methanol, ethanol, isopropanol, n-propanol, ethoxy propanol, n-butanol, sec-butanol, tert-butanol, iso-butanol, 2-ethylhexyl-alcohol and mixtures thereof); polyols (such as for example glycerol, 1,5-pentanediol, 1,2,6-hexanetriol and mixtures thereof); esters (such as for example ethyl acetate, n-propyl acetate, n-butyl acetate and mixtures thereof); carbonates (such as for example dimethyl carbonate, diethylcarbonate, di-n-butylcarbonate, 1,2-ethylencarbonate, 1,2-propylenecarbonate, 1,3-propylencarbonate and mixtures thereof); aromatic solvents (such as for example toluene, xylene and mixtures thereof); ketones and ketone alcohols (such as for example acetone, methyl ethyl ketone, methyl isobutyl ketone, cyclohexanone, diacetone alcohol and mixtures thereof); amides (such as for example dimethylformamide, dimethyl-acetamide and mixtures thereof); aliphatic or cycloaliphatic hydrocarbons; chlorinated hydrocarbons (such as for example dichloromethane); nitrogen-containing heterocyclic compound (such as for example N-methyl-2-pyrrolidone, 1,3-dimethyl-2-imidazolidone and mixtures thereof); ethers (such as for example diethyl ether, tetrahydrofuran, dioxane and mixtures thereof); alkyl ethers of a polyhydric alcohol (such as for example 2-methoxyethanol, 1-methoxypropan-2-ol and mixtures thereof); alkylene glycols, alkylene thioglycols, polyalkylene glycols or polyalkylene thioglycols (such for example ethylene glycol, polyethylene glycol (such as for example diethylene glycol, triethylene glycol, tetraethylene glycol), propylene glycol, polypropylene glycol (such as for example dipropylene glycol, tripropylene glycol), butylene glycol, thiodiglycol, hexylene glycol and mixtures thereof); nitriles (such as for example acetonitrile, propionitrile and mixtures thereof), and sulfur-containing compounds (such as for example dimethylsulfoxide, sulfolan and mixtures thereof). Preferably, the one or more organic solvents are selected from the group consisting of alcohols, esters and mixtures thereof.

According to another aspect of the present invention, the optically variable composition described herein and/or the magnetic composition described herein and/or the non-magnetic composition when present consist of radiation curable coating compositions. Radiation curable coating compositions include compositions that may be cured by UV-visible light radiation (hereafter referred as UV-Vis-curable) or by E-beam radiation (hereafter referred as EB). Radiation curable coating compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. Preferably, the coating compositions described herein consist of UV-Vis-curable coating compositions. Preferably the UV-Vis-curable coating compositions described herein are prepared from oligomers (also referred in the art as prepolymers) selected from the group consisting of radically curable compounds, cationically curable compounds and mixtures thereof. Cationically curable compounds are cured by cationic mechanisms consisting of the activation by energy of one or more photoinitiators which liberate cationic species, such as acids, which in turn initiate the polymerization so as to form the binder. Radically curable compounds are cured by free radical mechanisms consisting of the activation by energy of one or more photoinitiators which liberate free radicals which in turn initiate the polymerization so as to form the binder. UV-Vis curing of a monomer, oligomer or prepolymer may require the presence of one or more photoinitiators and may be performed in a number of ways. As known by those skilled in the art, the one or more photoinitiators are selected according to their absorption spectra and are selected to fit with the emission spectra of the radiation source. Depending on the monomers, oligomers or prepolymers used in the UV-Vis-curable coating compositions described herein, different photoinitiators might be used. Suitable examples of free radical photoinitiators are known to those skilled in the art and include without limitation acetophenones, benzophenones, alpha-aminoketones, alpha-hydroxyketones, phosphine oxides and phosphine oxide derivatives and benzyldimethyl ketals. Suitable examples of cationic photoinitiators are known to those skilled in the art and include without limitation onium salts such as organic iodonium salts (e.g. diaryl iodoinium salts), oxonium (e.g. triaryloxonium salts) and sulfonium salts (e.g. triarylsulphonium salts). Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. Typical examples of suitable photosensitizers include without limitation isopropyl-thioxanthone (ITX), 1-chloro-2-propoxy-thioxanthone (CPTX), 2-chloro-thioxanthone (CTX) and 2,4-diethyl-thioxanthone (DETX) and mixtures thereof. The one or more photoinitiators comprised in the UV-Vis-curable coating compositions are preferably present in an amount from about 0.1 wt-% to about 20 wt-%, more preferably about 1 wt-% to about 15 wt-%, the weight percents being based on the total weight of the UV-Vis-curable coating compositions.

Alternatively, dual-cure coating compositions may be used; these coating compositions combine thermal drying and radiation curing mechanisms. Typically, such compositions are similar to radiation curing compositions but include a volatile part constituted by water and/or by solvent. These volatile constituents are evaporated first using hot air and/or IR driers, and UV-Vis drying is then completing the hardening process.

The optically variable composition described herein and/or the magnetic composition described herein and/or the non-magnetic composition when used may further comprise one or more machine readable materials with specific spectral characteristics; preferably the one or more machine readable materials are independently selected from the group consisting of luminescent materials.

The optically variable composition described herein and/or the magnetic composition described herein and/or the non-magnetic composition when used may independently further comprise one or more additives including without limitation compounds and materials which are used for adjusting physical, rheological and chemical parameters of the composition such as the viscosity (e.g. solvents and surfactants), the consistency (e.g. anti-settling agents, fillers and plasticizers), the foaming properties (e.g. antifoaming agents), the lubricating properties (waxes), UV reactivity and stability (photosensitizers and photostabilizers) and adhesion properties, etc. Additives described herein may be present in the compositions described herein in amounts and in forms known in the art, including in the form of so-called nano-materials where at least one of the dimensions of the particles is in the range of 1 to 1000 nm.

The optically variable composition described herein and/or the magnetic composition described herein and/or the non-magnetic composition when used may be independently prepared by dispersing or mixing the optically variable pigment particles, the core-shell pigment particles, the one or more dyes, the one or more inorganic pigments, the one or more inorganic pigments described herein, as the case may be, and the one or more additives when present in the presence of a binder described herein, thus forming liquid or pasty compositions. When present, the one or more photoinitiators may be added to the composition either during the dispersing or mixing step of all other ingredients or may be added at a later stage, i.e. after the formation of the liquid or pasty composition.

Figure 5A:
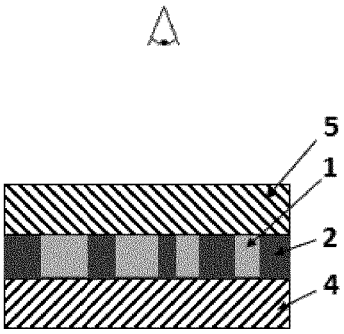
FIG. 5A-B schematically illustrate cross sections of security threads and stripes comprising an additional non-metallized substrate according to the present invention.
Figure 5B:
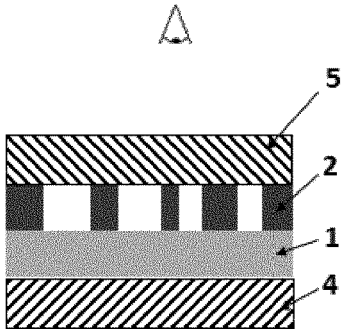

The security thread or stripe described herein may further comprise, in addition to the non-metallized substrate described herein an additional non-metallized substrate provided that the optically variable layer, the magnetic code and the non-magnetic layer when present are at least partially jointly visible from one side of the security thread or stripe. As exemplified in FIGS. 5A-B, the additional non-metallized substrate (5) faces the environment, i.e. faces outwardly, and the optically variable layer (1), the magnetic code (2) and the optional non-magnetic layer being at least partially jointly visible from one side of the security thread or stripe (see eyes in FIG. 5A-B). The non-metallized substrate described herein and the optional additional non-metallized substrate described herein may be different or may be the same. FIG. 5A exemplifies a security thread or stripe comprising a non-metallized substrate (4) such as those described herein a discontinuous optically variable layer (1) such as those described herein, a magnetic code (2) such as those described herein and an additional non-metallized substrate (5), wherein the optically variable layer (1) and the magnetic code (2) are comprised between the two non-metallized substrates (4 and 5) and wherein the optically variable layer (1) and the magnetic code (2) are at least partially jointly visible from one side of the security thread or stripe. FIG. 5B exemplifies a security thread or stripe comprising a non-metallized substrate (4) such as those described herein a continuous optically variable layer (1) such as those described herein, a magnetic code (2) such as those described herein and an additional non-metallized substrate (5), wherein the optically variable layer (1) and the magnetic code (2) are comprised between the two non-metallized substrates (4 and 5) and wherein the optically variable layer (1) and the magnetic code (2) are at least partially jointly visible from one side of the security thread or stripe.

Preferably, the additional non-metallized substrate described herein is made of one or more plastics or polymers more preferably selected form the group consisting of polyolefins (e.g. polyethylene and polypropylene), polyamides, polyesters (e.g. poly(ethylene terephthalate) (PET), poly(1,4-butylene terephthalate) (PBT) and poly(ethylene 2,6-naphthoate) (PEN)), polyvinylchlorides (PVC) and mixtures thereof.

The security thread or stripe described herein may further comprise one or more additional layers, said one or more additional layers being preferably selected from the group consisting of adhesive layers, protective layers, machine readable layers and combinations thereof, provided that the optically variable layer, the magnetic code and the non-magnetic layer when present are at least partially jointly visible from one side of the security thread or stripe. When present, the one or more additional layers may be continuous or discontinuous.

The security thread or stripe described herein may further comprise one or more adhesive layers, preferably one or more thermoadhesive layers, on at least one surface of said security thread or stripe so as to provide adherence to a security document upon incorporation of the security thread or stripe into or onto said security document, provided that the optically variable layer, the magnetic code and the non-magnetic layer when present are at least partially jointly visible from one side of the security thread or stripe.

The security thread or stripe described herein may further comprise one or more machine readable layers comprising one or more machine readable materials selected from the group consisting of luminescent materials, infrared-absorbing materials and mixtures thereof, provided that the optically variable layer, the magnetic code and the non-magnetic layer when present are at least partially jointly visible from one side of the security thread or stripe.

With the aim of increasing the wear and soil resistance or with the aim of modifying the optical gloss or aesthetic appearance of the security thread or stripe described herein, the security thread or stripe described herein may further comprise one or more protective layers. The one or more protective layers may be more or less glossy. Protective layers are typically made of protective varnishes, wherein said varnishes may be radiation curable compositions, thermal drying compositions or any combination thereof.

The present invention provides processes for producing the security threads or stripes described herein as well as security threads or stripes obtained thereof.

According to one embodiment of the present invention, the process described herein comprises the steps of:

a) applying and hardening or at least partially hardening the magnetic composition described herein onto the non-metallized substrate described herein so as to form a magnetic code, b) applying and hardening or at least partially hardening the optically variable composition described herein so as to form an optically variable layer on the structure obtained under step a) either while keeping one or more gaps in the form of indicia or by applying the optically variable composition in the form of indicia, c) optionally applying a thermoadhesive layer on one or both sides of the structure obtained under step b), and d) optionally applying and hardening or at least partially hardening the non-magnetic composition described herein so as to form a non-magnetic layer said step being performed before step a), after step a) or after step b).

According to another embodiment of the present invention, the process described herein comprises the steps of:

a) applying and hardening or at least partially hardening the optically variable composition described herein so as to form a optically variable layer on the non-metallized substrate described herein, said optically variable layer being continuous or said optically variable layer comprising one or more gaps in the form of indicia or consisting of indicia, b) applying and hardening or at least partially hardening the magnetic composition described herein so as to form the magnetic code on the structure obtained under step a), and c) optionally applying a thermoadhesive layer on one or both sides of the structure obtained under step b), and d) optionally applying and hardening or at least partially hardening the non-magnetic composition described herein so as to form a non-magnetic layer said step being performed before step a), after step a) or after step b).

The optically variable composition, the magnetic composition and the non-magnetic composition when used are preferably applied by a printing process so as to form the optically variable layer, the magnetic code and the non-magnetic layer, respectively. Using printing processes for producing the security threads or stripes described herein provides a high flexibility in terms of designs and color combinations. The optically variable composition, the magnetic composition and the non-magnetic composition when used are preferably applied by a printing process independently selected form the group consisting of screen printing, rotogravure printing, flexography printing and intaglio printing, more preferably from the group consisting of screen printing, rotogravure printing and flexography printing.

Screen printing (also referred in the art as silkscreen printing) is a stencil process whereby an ink is transferred to a surface through a stencil supported by a fine fabric mesh of silk, mono- or multi-filaments made of synthetic fibers such as for example polyamides or polyesters or metal threads stretched tightly on a frame made for example of wood or a metal (e.g. aluminum or stainless steel). Alternatively, the screen-printing mesh may be a chemically etched, a laser-etched, or a galvanically formed porous metal foil, e.g. a stainless steel foil. The pores of the mesh are block-up in the non-image areas and left open in the image area, the image carrier being called the screen. Screen printing might be flat-bed or rotary. Screen printing is further described for example in The Printing ink manual, R. H. Leach and R. J. Pierce, Springer Edition, $5^{th}$ Edition, pages 58-62 and in Printing Technology, J. M. Adams and P. A. Dolin, Delmar Thomson Learning, 5th Edition, pages 293-328.

Rotogravure (also referred in the art as gravure) is a printing process wherein the image elements are engraved into the surface of a cylinder. The non-image areas are at a constant original level. Prior to printing, the entire printing plate (non-printing and printing elements) is inked and flooded with ink. Ink is removed from the non-image by a wiper or a blade before printing, so that ink remains only in the cells. The image is transferred from the cells to the substrate by a pressure typically in the range of 2 to 4 bars and by the adhesive forces between the substrate and the ink. The term rotogravure does not encompass intaglio printing processes (also referred in the art as engraved steel die or copper plate printing processes) which rely for example on a different type of ink. More details are provided in "Handbook of print media", Helmut Kipphan, Springer Edition, page 48 and in The Printing ink manual, R. H. Leach and R. J. Pierce, Springer Edition, 5th Edition, pages 42-51.

Flexography preferably uses a unit with a doctor blade, preferably a chambered doctor blade, an anilox roller and plate cylinder. The anilox roller advantageously has small cells whose volume and/or density determines the ink application rate. The doctor blade lies against the anilox roller, and scraps off surplus ink at the same time. The anilox roller transfers the ink to the plate cylinder which finally transfers the ink to the substrate. Specific design might be achieved using a designed photopolymer plate. Plate cylinders can be made from polymeric or elastomeric materials. Polymers are mainly used as photopolymer in plates and sometimes as a seamless coating on a sleeve. Photopolymer plates are made from light-sensitive polymers that are hardened by ultraviolet (UV) light. Photopolymer plates are cut to the required size and placed in an UV light exposure unit. One side of the plate is completely exposed to UV light to harden or cure the base of the plate. The plate is then turned over, a negative of the job is mounted over the uncured side and the plate is further exposed to UV light. This hardens the plate in the image areas. The plate is then processed to remove the unhardened photopolymer from the nonimage areas, which lowers the plate surface in these nonimage areas. After processing, the plate is dried and given a post-exposure dose of UV light to cure the whole plate. Preparation of plate cylinders for flexography is described in Printing Technology, J. M. Adams and P. A. Dolin, Delmar Thomson Learning, 5th Edition, pages 359-360 and in The Printing ink manual, R. H. Leach and R. J. Pierce, Springer Edition, 5th Edition, pages 33-42.

Intaglio printing is referred in the art as engraved copper plate printing and engraved steel die printing). During intaglio printing processes, an engraved steel cylinder carrying a plate engraved with a pattern or image to be printed is supplied with ink of inking cylinder(s) (or chablon cylinder), each inking cylinder being inked in at least one corresponding color to form security features. Subsequent to the inking, any excess of ink on the on the surface of the intaglio printing plate is wiped off by a rotating wiping cylinder. The remaining ink in the engraving of the printing cylinder is transferred under pressure onto the substrate to be printed while the wiping cylinder is cleaned by a wiping solution. Other wiping techniques can also be used, such as paper wiping or tissue wiping ("calico"). Subsequently to the wiping steps, the inked intaglio plate is brought into contact with the substrate and the ink is transferred under pressure from the engravings of the intaglio printing plate onto the substrate to be printed forming a thick printing pattern on the substrate. One of the distinguishing features of the intaglio printing process is that the film thickness of the ink transferred to the substrate can be varied from a few micrometers to several tens of micrometers by using correspondingly shallow or respectively deep recesses of the intaglio printing plate. Intaglio relief resulting from the intaglio ink layer thickness is emphasized by the embossing of the substrate, said embossing being produced by the pressure during the ink transfer. The tactility resulting from intaglio printing gives the banknotes their typical and recognizable touch feeling. In comparison with screen printing, rotogravure printing and flexography printing which require liquid inks, intaglio printing relies on greasy and pasty (highly viscous) inks, having a viscosity in the range of 5 to 40 Pa·s at 40° C. and 1000 $s^{-1}$. Intaglio printing is further described for example in The Printing ink manual, R. H. Leach and R. J. Pierce, Springer Edition, 5th Edition, page 74 and in Optical Document Security, R. L. van Renesse, 2005, 3rd Edition, pages 115-117.

Subsequently to the application, preferably by the printing process described herein, of the optically variable composition, the magnetic composition and optional non-magnetic composition when used, said compositions are hardened or at least partially hardened. The hardening steps described herein may be any step that increases the viscosity of the composition such that a substantially solid material adhering to the substrate is formed. As described hereabove, the hardening steps described herein may independently involve a physical process based on the evaporation of a volatile component, such as a solvent, and/or water evaporation (i.e. physical drying). Herein, hot air, infrared or a combination of hot air and infrared may be used. Alternatively, the hardening steps described herein may independently include a chemical reaction which is not reversed by a simple temperature increase that may occur during a typical use of the security thread described, such as a curing, polymerizing or cross-linking of the binder and optional initiator compounds and/or optional cross-linking compounds comprised in the composition. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis curing) and electronic beam radiation curing (E-beam curing); oxypolymerization (oxidative reticulation, typically induced by a joint action of oxygen and one or more catalysts preferably selected from the group consisting of cobalt-containing catalysts, vanadium-containing catalysts, zirconium-containing catalysts, bismuth-containing catalysts, and manganese-containing catalysts); cross-linking reactions or any combination thereof.

When the optically variable composition comprises the magnetic optically variable pigment particles described herein, said optically variable pigment particles may be oriented in the optically variable layer of the security thread described herein, i.e. not randomly distributed. By comprising the magnetic optically variable pigment particles, the optically variable composition described herein is well-suited for producing security threads exhibiting dynamic, three-dimensional, illusionary, and/or kinematic images by aligning the pigment within the optically variable composition with a magnetic field. A large variety of optical effects can be produced by various methods disclosed for example in U.S. Pat. No. 6,759,097, EP 2 165 774 A1 and EP 1 878 773 B1. Optical effects known as flip-flop effects (also referred in the art as switching effect) may be produced. Flip-flop effects include a first printed portion and a second printed portion separated by a transition, wherein pigment particles are aligned parallel to a first plane in the first portion and pigment particles in the second portion are aligned parallel to a second plane. Methods for producing flip-flop effects are disclosed for example in EP 1 819 525 B1. Optical effects known as rolling-bar effects may also be produced. Rolling-bar effects show one or more contrasting bands which appear to move ("roll") as the image is tilted with respect to the viewing angle, said optical effects are based on a specific orientation of magnetic or magnetizable pigment particles, said pigment particles being aligned in a curving fashion, either following a convex curvature (also referred in the art as negative curved orientation) or a concave curvature (also referred in the art as positive curved orientation). Methods for producing rolling-bar effects are disclosed for example in EP 2 263 806 A1, EP 1 674 282 B11, EP 2 263 807 A1, WO 2004/007095 A2 and WO 2012/104098 A1. Optical effects known as Venetian-blind effects may also be produced. Venetian-blind effects include pigment particles being oriented such that, along a specific direction of observation, they give visibility to an underlying substrate surface, such that indicia or other features present on or in the substrate surface become apparent to the observer while they impede the visibility along another direction of observation. Methods for producing Venetian-blind effects are disclosed for example in U.S. Pat. No. 8,025,952 and EP 1 819 525 B1. Optical effects known as moving-ring effects may also be produced. Moving-ring effects consists of optically illusive images of objects such as funnels, cones, bowls, circles, ellipses, and hemispheres that appear to move in any x-y direction depending upon the angle of tilt of said optical effect layer. Methods for producing moving-ring effects are disclosed for example in EP 1 710 756 A1, U.S. Pat. No. 8,343,615, EP 2 306 222 A1, EP 2 325 677 A2, WO 2011/092502 A2 and U.S. 2013/084411.

When the optically variable composition comprising the optically variable pigment particles described herein is still wet or soft enough so that the particles therein can be moved and rotated (i.e. while the optically variable composition is in a first state), the optically variable composition may be subjected to a magnetic orientation step, i.e. the optically variable composition may be subjected to a magnetic field to achieve orientation of the particles. The step of magnetically orienting the particles comprises a step of exposing the applied optically variable composition, while it is "wet" (i.e. still liquid and not too viscous, that is, in a first state), to a determined magnetic field generated by a magnetic-field-generating device, thereby orienting the particles along the field lines of the magnetic field such as to form an orientation pattern. The step of exposing the optically variable composition comprising the magnetic optically variable pigment particles described herein thereof to a magnetic field can be performed partially simultaneously, simultaneously or subsequently with the step of applying the optically variable composition or subsequently to said step. That is, both steps may be performed partially simultaneously or simultaneously or subsequently.

The process for producing the security thread or stripe described herein comprising the optically variable composition comprising the magnetic optically variable pigment particles described herein, comprises, partially simultaneously with the magnetic orienting step or subsequently to the magnetic orienting step, a step of at least partially hardening such as described hereabove the optically variable composition so as to fix the particles in their adopted positions and orientations in a desired pattern, thereby transforming the optically variable composition to a second state. By this fixing, a solid optically variable layer is formed.

When the optically variable composition comprising the magnetic optically variable pigment particles described herein is subjected to an orientation step so as to orient the pigment particles described herein, it is particularly preferred to at least partially harden said optically variable composition by radiation curing and more preferably by UV-Vis light radiation curing, since these technologies advantageously lead to very fast curing processes and hence drastically decrease the preparation time of the security thread described herein. Moreover, radiation curing has the advantage of producing an almost instantaneous increase in viscosity of the optically variable composition after exposure to the curing radiation, thus minimizing any further movement of the particles.

The process for producing the security threads or stripes described herein may further comprise a step of applying, preferably by a printing process, one or more protective varnishes so as to form one or more protective layers on the optically variable layer and/or the magnetic code as the case may be (i.e. on the side facing the environment), said step being carried out after step b).

The process for producing the security thread or stripe described herein invention may further comprise a step c) of applying one or more adhesive layers, preferably one or more thermoadhesive layers, on one or both sides of the structure obtained under step b) described herein or on the structure obtained under step b) and further comprising one or more protective layers. Applying one or more adhesive layers, preferably one or more thermoadhesive layers, on one or both sides of the structure obtained under step b) described herein provides adherence to a security document upon incorporation of the thread or stripe into or onto said security document.

The process for producing the security thread or stripe described herein may further comprise a step of applying an additional non-metallized substrate on the structure obtained under step b) described herein, provided that the optically variable layer, the magnetic code and the non-magnetic layer when present are at least partially jointly visible from one side of the security thread or stripe. The security threads or stripes described herein comprising an additional non-metallized substrate such as those described hereabove, said additional non-metallized substrate facing the environment may be prepared by laminating a) a first structure comprising the non-metallized substrate described herein, the optically variable layer described herein and the magnetic code described herein with b) the additional non-metallized substrate described herein, wherein the optically variable layer, the magnetic code and the optional non-magnetic layer are placed between the non-metallized substrate and the additional non-metallized substrate, wherein the optional non-magnetic layer, when present, is either present in the first structure or the second structure before lamination. Alternatively, security threads or stripes described herein comprising the additional non-metallized substrate described herein such as those described hereabove may be prepared by laminating a) a first structure comprising the non-metallized substrate described herein and one of the optically variable layer and magnetic code described herein with b) a second structure comprising the additional non-metallized substrate described herein and the other of the optically variable layer and magnetic code described herein, wherein the optically variable layer, the magnetic code and the optional non-magnetic layer are placed between the non-metallized substrate and the additional non-metallized substrate, wherein the optional non-magnetic layer, when present, is either present in the first structure or the second structure before lamination. Lamination may be performed by a conventional lamination process known in the art such as for example a processes consisting of applying heat and/or pressure on the first and second structures optionally further comprising an additional material present at least one of the surface to be bonded. Typically, the additional material consists of a conventional lamination adhesive layer or a conventional tie layer which may be water-based, solvent-based, solvent-free or UV-curable compositions. In an embodiment, the process comprises a step of applying one or more adhesive layers on the first structure and/or on the second structure to adhere the first and second structures together in the laminated structure.

A further step consisting of slicing the security threads or stripes described herein may be achieved so as to provide security threads or stripes having preferably a width, i.e. dimension in the transverse direction, between about 0.5 mm and about 30 mm, more preferably between about 0.5 mm and about 5 mm. When a step of applying one or more adhesive layers, preferably one or more thermoadhesive layers, on one or both sides of the structure obtained as described herein is performed, the step of slicing the structure is carried out subsequently to the applying one or more adhesive layers step.

The security threads or stripes described herein are particularly suitable for the protection of a security document against counterfeiting, fraud or illegal reproduction. Also described herein are security documents comprising said security threads or stripes.

Security documents are usually protected by several security features which are chosen from different technology fields, manufactured by different suppliers, and embodied in different constituting parts of the security document. To break the protection of the security document, the counterfeiter would need to obtain all of the implied materials and to get access to all of the required processing technology, which is a hardly achievable task. Examples of security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, bank cards, credit cards, transactions cards, access documents, entrance tickets and the like. The term "value commercial good" refers to packaging material, in particular for pharmaceutical, cosmetics, electronics or food industry that may comprise one or more security features in order to warrant the content of the packaging like for instance genuine drugs. Examples of these packaging materials include without limitation labels such as authentication brand labels, tamper evidence labels and seals. Preferably, the security document described herein is selected from the group consisting of banknotes, identity documents such as passports, identity cards, driving licenses and the like and more preferably banknotes.

With the aim of increasing the wear and soil resistance or with the aim of modifying the optical gloss or aesthetic appearance of the security document described herein, the security document described herein may further comprise one or more protective layers such as those described hereabove.

Also described herein are processes for producing a security document comprising the security thread or stripe described herein and security documents obtained thereof. The processes for producing a security document comprising the security thread or stripe described herein comprising a step at least partially embedding in said security document the security thread or stripe described herein or mounting the security thread or stripe described herein on the surface of the security document, wherein the optically variable layer, the magnetic code and the optional non-magnetic layer are jointly visible from one side of the security document.

As mentioned hereabove, the security thread or stripe described herein may be at least partially embedded into the security document as a windowed security thread or stripe so that said security thread or stripe is at least partially visible from one side of the security document. When the security document comprises a substrate being a security paper, the security thread or stripe described herein may be at least partially embedded incorporated in the security paper during manufacture by techniques commonly employed in the paper-making industry. For example, the security thread or stripe described herein may be pressed within wet paper fibers while the fibers are unconsolidated and pliable, thus resulting in the security thread or stripe being totally embedded in the resulting security paper. The security thread or stripe described herein may also be fed into a cylinder mold papermaking machine, cylinder vat machine, or similar machine of known type, resulting in partial embedment of the security thread or stripe within the body of the finished paper (i.e. windowed paper).

Alternatively, the security thread or stripe described herein may be disposed completely on the surface of the security document as a transfer element. In such as case, the security thread or stripe described herein may be mounted on the surface of the security document by any known techniques including without limitation applying a pressure-sensitive adhesive to a surface of the security thread or stripe, applying a heat activated adhesive to a surface of the security thread or stripe or using thermal transfer techniques, provided that the optically variable layer, the magnetic code and the optional non-magnetic layer are jointly visible from one side of the security document.

The invention claimed is:

1. A security thread or stripe comprising:

i) an optically variable layer imparting a different color impression at different viewing angles and being made of an optically variable composition comprising optically variable pigment particles;

ii) a magnetic code made of a magnetic composition comprising pigment particles, one or more infrared transparent dyes and/or one or more infrared transparent pigments, said pigment particles comprising a magnetic core having a shape of a sphere surrounded by a layer made of one or more inorganic materials, and iii) a non-metallized substrate, wherein the magnetic code has a color matching the color impression of the optically variable layer at one viewing angle, wherein the optically variable layer and the magnetic code are jointly visible from one side of the security thread or stripe, and wherein the pigment particles comprise the magnetic core surrounded by a first layer made of one or more inorganic materials and a second layer made of one or more inorganic materials, wherein at least one of the first layer and second layer is made of one or more inorganic materials being metals and wherein the second layer is not made of a same material as the first layer.

2. The security thread or stripe according to claim 1, wherein the optically variable layer comprises one or more gaps in the form of indicia or consists of indicia made of the optically variable composition.

3. The security thread or stripe according to claim 1, wherein the magnetic core is made of one or more materials selected from the group consisting of iron, $Fe_2O_3$ and $Fe_3O_4$ and mixtures or combinations thereof.

4. The security thread or stripe according to claim 1, wherein at least a part of the optically variable pigment particles consists of thin film interference pigments, magnetic thin film interference pigments, interference coated pigments, cholesteric liquid crystal pigments, magnetic cholesteric liquid crystal pigments and mixtures thereof.

5. The security thread or stripe according to claim 1, further comprising a non-magnetic layer made of a non-magnetic composition, said non-magnetic layer having a color matching the color impression of the magnetic code, wherein the optically variable layer, the magnetic code and the non-magnetic layer are jointly visible from one side of the security thread or stripe.

6. The security thread or stripe according to claim 1, wherein the non-metallized substrate is selected from the group consisting of plastics, polymers, composite materials, and combinations or mixtures thereof.

7. The security thread or stripe according to claim 1, further comprising an additional non-metallized substrate.

8. The security thread or stripe according to claim 1, further comprising one or more additional layers selected from the group consisting of adhesive layers, protective layers, machine readable layers, and combinations thereof.

9. The security thread or stripe according to claim 1, wherein when the one or more inorganic materials are metals, said metals are selected from the group consisting of silver, aluminum and gold.

10. A security document against counterfeiting, fraud or illegal reproduction comprising the security thread or stripe according to claim 1.

11. A process for making the security thread or stripe recited in claim 1, comprising the steps of:

a) applying and hardening or at least partially hardening a magnetic composition comprising pigment particles, one or more infrared transparent dyes and/or one or more infrared transparent pigments, onto the non-metallized substrate so as to form a magnetic code, and b) applying and hardening or at least partially hardening an optically variable composition so as to form an optically variable layer on the structure obtained under step a) either while keeping one or more gaps in the form of indicia or by applying the optically variable composition in the form of indicia.

12. The process according to claim 11 further comprising a step of laminating a first structure comprising the non-metallized substrate, the optically variable layer and the magnetic code with an additional non-metallized substrate, wherein the optically variable layer, the magnetic code and the optional non-magnetic layer are placed between the non-metallized substrate and the additional non-metallized substrate.

13. The process according to claim 11, further comprising step c) applying a thermoadhesive layer on one or both sides of the structure obtained under step b).

14. The process according to claim 11, further comprising step d) applying and hardening or at least partially hardening a non-magnetic composition so as to form a non-magnetic layer said step being performed before step a), after step a) or after step b), wherein non-magnetic layer has a color matching the color impression of the magnetic code, wherein the optically variable layer, the magnetic code and the non-magnetic layer are jointly visible from one side of the security thread or stripe.

15. A process for making the security thread or stripe recited in claim 1, comprising the steps of:

a) applying and hardening or at least partially hardening an optically variable composition so as to form an optically variable layer on the non-metallized substrate, said optically variable layer being continuous or said optically variable layer comprising one or more gaps in the form of indicia or consisting of indicia, and b) applying and hardening or at least partially hardening a magnetic composition comprising pigment particles, one or more infrared transparent dyes and/or one or more infrared transparent pigments, so as to form the magnetic code on the structure obtained under step a).

16. The process according to claim 15, further comprising step c) applying a thermoadhesive layer on one or both sides of the structure obtained under step b).

17. The process according to claim 15, further comprising step d) applying and hardening or at least partially hardening the a non-magnetic composition so as to form a non-magnetic layer said step being performed before step a), after step a) or after step b), wherein the non-magnetic layer has a color matching the color impression of the magnetic code, wherein the optically variable layer, the magnetic code and the non-magnetic layer are jointly visible from one side of the security thread or stripe.

18. The process according to claim 15 further comprising a step of laminating a first structure comprising the non-metallized substrate, the optically variable layer and the magnetic code with an additional non-metallized substrate, wherein the optically variable layer, the magnetic code and an optional non-magnetic layer are placed between the non-metallized substrate and the additional non-metallized substrate.

19. A security document comprising the security thread or stripe recited in claim 1.

20. A process for making the security document recited in claim 19, comprising a step of at least partially embedding in the security document the security thread or stripe or mounting the security thread or stripe on a surface of the security document, wherein the optically variable layer, the magnetic code and the optional non-magnetic layer are jointly visible from one side of the security document.

* * * * *